US008345914B2

(12) United States Patent
Liu et al.

(10) Patent No.: US 8,345,914 B2
(45) Date of Patent: Jan. 1, 2013

(54) VOICE COIL BOBBIN AND LOUDSPEAKER USING THE SAME

(75) Inventors: Liang Liu, Beijing (CN); Jia-Ping Wang, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 255 days.

(21) Appl. No.: 12/824,345

(22) Filed: Jun. 28, 2010

(65) Prior Publication Data

US 2011/0051984 A1 Mar. 3, 2011

(30) Foreign Application Priority Data

Aug. 28, 2009 (CN) ..... 2009 1 0189913

(51) Int. Cl.
*H04R 1/02* (2006.01)

(52) U.S. Cl. ..... 381/394; 977/742; 977/949

(58) Field of Classification Search ..... 977/742, 977/902, 949; 381/394, 423
See application file for complete search history.

(56) References Cited

U.S. PATENT DOCUMENTS 4,312,118 A 1/1982 Saik et al.
6,597,798 B1 * 7/2003 Nakazono et al. ..... 381/410
6,639,993 B2 * 10/2003 Kemmerer et al. ..... 381/397
6,808,746 B1 10/2004 Dai et al.
8,068,626 B2 * 11/2011 Jiang et al. ..... 381/164
8,073,164 B2 * 12/2011 Jiang et al. ..... 381/164
2004/0020681 A1 2/2004 Hjortstam et al.
2004/0053780 A1 3/2004 Jiang et al.
2008/0248235 A1 10/2008 Feng et al.
2008/0260188 A1 * 10/2008 Kim ..... 381/190
2008/0304694 A1 12/2008 Hayashi
2009/0045005 A1 * 2/2009 Byon et al. ..... 181/167
2009/0068448 A1 3/2009 Liu et al.
2009/0074228 A1 3/2009 Mango, III et al.
2009/0153502 A1 6/2009 Jiang et al.
2009/0155467 A1 6/2009 Wang et al.
2009/0160799 A1 6/2009 Jiang et al.
2009/0197082 A1 8/2009 Jiang et al.
2009/0268559 A1 * 10/2009 Jiang et al. ..... 367/140
2009/0272935 A1 11/2009 Hata et al.
2009/0296528 A1 * 12/2009 Jiang et al. ..... 367/140
2010/0046784 A1 * 2/2010 Jiang et al. ..... 381/386

(Continued)

FOREIGN PATENT DOCUMENTS

CN 2488247 4/2002

(Continued)

OTHER PUBLICATIONS

Lin Xiao et al. "Flexible, Stretchable, Transparent Carbon Nanotube Thin Film Loudspeakers" NANO Letters, Oct. 29, 2008.*

(Continued)

*Primary Examiner* — Jeffrey Donels
(74) *Attorney, Agent, or Firm* — Altis Law Group, Inc.

(57) ABSTRACT

A loudspeaker includes a frame, a magnetic circuit, a voice coil bobbin, and a voice coil. The frame is mounted on a side of the magnetic circuit. The magnetic circuit defines a magnetic gap. The voice coil bobbin is disposed in the magnetic gap. The voice coil is wound around the voice coil bobbin. The voice coil bobbin includes a carbon nanotube layer structure. The carbon nanotube layer structure includes a plurality of carbon nanotubes.

20 Claims, 9 Drawing Sheets

U.S. PATENT DOCUMENTS

2010/0188934 A1* 7/2010 Qian et al. ..... 367/140

FOREIGN PATENT DOCUMENTS

| | | |
|---|---|---|
| CN | 1430785 | 7/2003 |
| CN | 1640923 | 7/2005 |
| CN | 101239712 | 8/2008 |
| CN | 101288336 | 10/2008 |
| CN | 101321410 | 12/2008 |
| CN | 101381071 | 3/2009 |
| CN | 101464759 | 6/2009 |
| JP | 60-27298 | 2/1985 |
| JP | 63-49991 | 12/1988 |
| JP | 7-138838 | 5/1995 |
| JP | 2002-171593 | 6/2002 |
| JP | 2002-542136 | 12/2002 |
| JP | 2003-319490 | 11/2003 |
| JP | 2004-32425 | 1/2004 |
| JP | 2004-107196 | 4/2004 |
| JP | 2006-147801 | 6/2006 |
| JP | 2007-182352 | 7/2007 |
| JP | 2007-290908 | 11/2007 |
| JP | 2009-144158 | 7/2009 |
| JP | 2009-146420 | 7/2009 |
| JP | 2009-184910 | 8/2009 |

OTHER PUBLICATIONS

Nanotubes made of carbon find an unexpected use. The Economist, Nov. 20, 2008.*

"Hot nanotube sheets produce music on demand." New Scientist, Oct. 31, 2008.*

Xiao et al.,Flexible, Stretchable, Transparent Carbon Nanotube Thin Film Loudspeakers,Nanoletter, vol. 8; No. 12, 4539-4545.

* cited by examiner

VOICE COIL BOBBIN AND LOUDSPEAKER USING THE SAME

RELATED APPLICATIONS

This application claims all benefits accruing under 35 U.S.C. §119 from China Patent Application No. 200910189913.1, filed on Aug. 28, 2009 in the China Intellectual Property Office, hereby incorporated by reference.

BACKGROUND

1. Technical Field

The present disclosure generally relates to a voice coil bobbin incorporating carbon nanotubes and a loudspeaker using the same.

2. Description of Related Art

Loudspeakers are well known electric/acoustic conversion devices, which convert electrical signals into acoustic signals. A conventional loudspeaker often includes a voice coil, a voice coil bobbin, a magnetic circuit, and a damper. The magnetic circuit is made up of a plate, a magnet, and a yoke, and is arranged at the lower end of the damper. High-density magnetic flux is formed in the magnetic gap between the yoke and the plate of the magnetic circuit. The voice coil is wound around the voice coil bobbin such that the voice coil and the voice coil bobbin can vibrate along the axial direction. However, the conventional voice coil bobbin is usually made of paper, cloth, or polymer, which cannot endure high temperatures. Thus, the voice coil bobbin is easily damaged when operated for a long period of time under high power.

What is needed, therefore, is a lighter voice coil bobbin and a loudspeaker using the same so the loudspeaker can have a high power rating.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
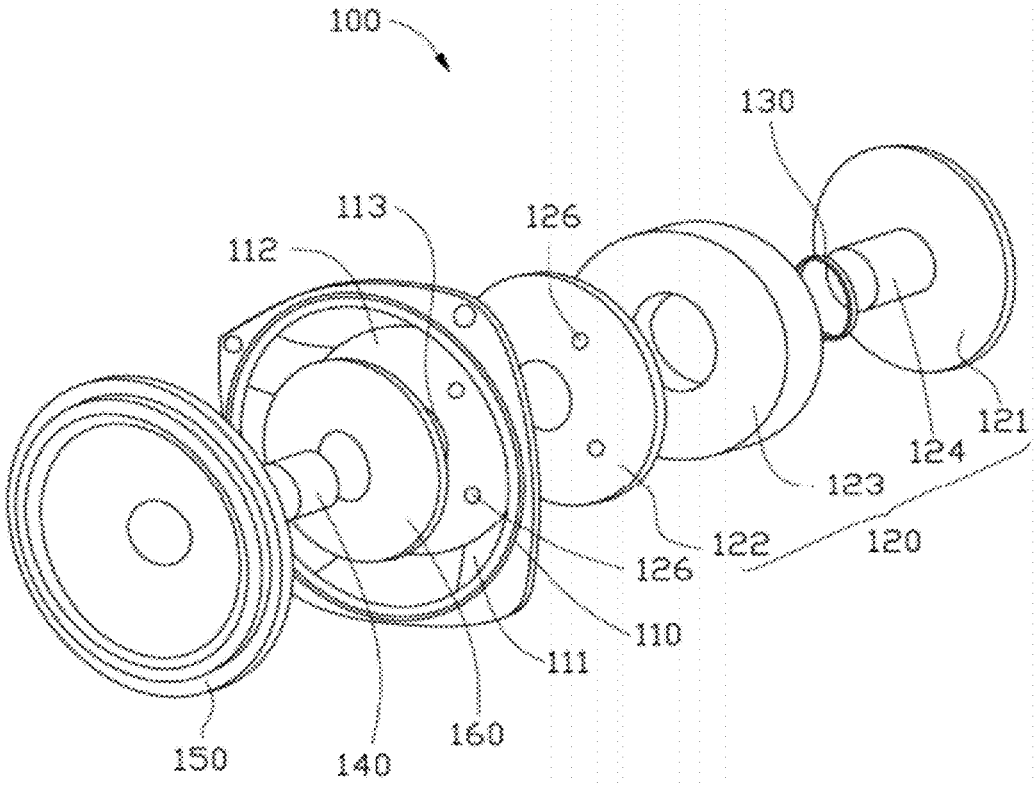
FIG. 1 is a schematic and exploded view of one embodiment of a loudspeaker.
Figure 2:
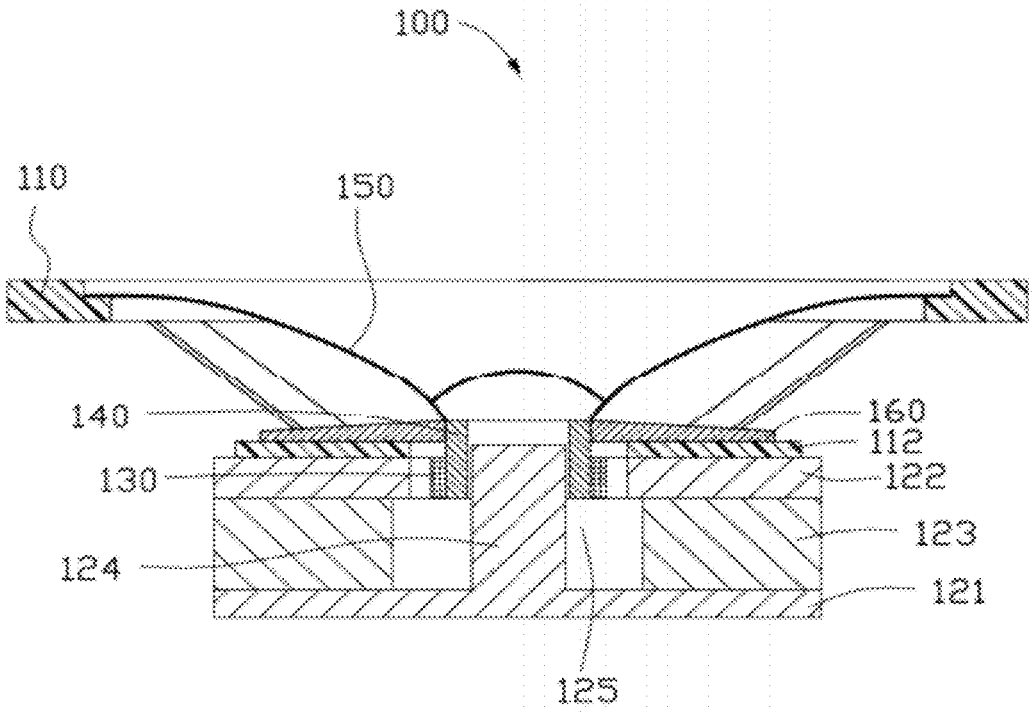
FIG. 2 is a schematic, cross-sectional view of the loudspeaker in FIG. 1.

Referring to FIGS. 1 and 2, one embodiment of a loudspeaker 100 includes a frame 110, a magnetic circuit 120, a voice coil 130, a voice coil bobbin 140, a diaphragm 150, and a damper 160. The frame 110 is mounted on a side of the magnetic circuit 120. The magnetic circuit 120 receives the voice coil 130.

The frame 110 has a structure of a truncated cone with an opening (not labeled) on one end. The frame 110 has a bottom 112 and a hollow cavity 111. The hollow cavity 111 receives the diaphragm 150 and the damper 160. The bottom 112 has a center hole 113. The bottom 112 of the frame 110 is fixed to the magnetic circuit 120.

The magnetic circuit 120 includes a lower plate 121, an upper plate 122, a magnet 123, and a magnet core 124. The magnet 123 is disposed between the upper plate 122 and the lower plate 121. The upper plate 122 and the magnet 123 can both be substantially ring shaped, and define a substantially cylindrical shaped magnetic gap 125 in the magnet circuit 120. The magnet core 124 is fixed on the lower plate 121, received in the magnetic gap 125, and extends through the center hole 113 of the bottom 112. The magnetic circuit 120 is fixed on the bottom 112 via the upper plate 122. The upper plate 122 can be combined with the bottom 112 via adhesive or mechanical force. In one embodiment according to FIG. 1, the upper plate 122 is fixed on the bottom 112 by screws (not shown) via screw holes 126.

The diaphragm 150 is a sound producing member of the loudspeaker 100. The diaphragm 150 can have a cone shape if used in a large sized loudspeaker 100. If the loudspeaker 100 has a smaller size, the diaphragm 150 can have a planar round shape or a planar rectangle shape. A material of the diaphragm 150 can be aluminum alloy, magnesium alloy, ceramic, fiber, or cloth. In one embodiment according to FIG. 1, the diaphragm 150 has a cone shape. The diaphragm 150 includes an outer rim (not labeled) and an inner rim (not labeled). The outer rim of the diaphragm 150 is fixed to the opening end of the frame 110, and the inner rim of the diaphragm 150 is fixed to the voice coil bobbin 140. Furthermore, an external input terminal (not shown) can be attached to the frame 110. A dust cap can be fixed over and above a joint portion of the diaphragm 150 and the voice coil bobbin 140.

The damper 160 is a substantially ring-shaped plate having radially alternating circular ridges and circular furrows. The damper 160 holds the diaphragm 150 mechanically. The damper 160 is fixed to the bottom 112 of the frame 110. An inner rim of the damper 160 is connected with the voice coil bobbin 140. The damper 160 has a relatively high rigidity along the radial direction thereof, and a relatively low rigidity along the axial direction thereof, so that the voice coil bobbin 140 can freely move up and down but not radially.

The voice coil 130 is a driving member of the loudspeaker 100. The voice coil 130 is disposed around an outer surface of the bobbin 140. When the electric signal is input into the voice coil 130, a magnetic filed can be formed by the voice coil 130 as the variation of the electric signals. The interaction of the magnetic filed caused by the voice coil 130 and the magnetic circuit 120 produces the vibration of the voice coil 130. The vibration of the voice coil 130 causes the voice coil bobbin 140 to vibrate, and then the diaphragm 150 fixed on the voice coil bobbin 140 will vibrate. The vibration of the diaphragm 150 causes the loudspeaker 100 to produce sound.

The voice coil 130 includes an end (not shown) electrically connected with an outer circuit. The voice coil 130 is formed by a lead wire (not labeled) wound around the voice coil bobbin 140. The lead wire winds around the voice coil bobbin 140 to form a plurality of wraps. The power rating of the loudspeaker 100 is related to the number of the wraps. The more wraps the voice coil 130 forms, the higher the power rating of the loudspeaker 100. The lead wire includes a metal wire and an insulated layer coated on a surface of the metal wire. A diameter of the lead wire can be in a range from about 0.5 micrometers to about 5 millimeters. A thickness of the insulated layer can be in a range from about 0.1 micrometers to about 0.5 millimeters.

The voice coil bobbin 140 is light in weight. The voice coil bobbin 140 has a tubular structure defining a hollow structure. The magnet core 124 is disposed in the hollow structure and spaced from the voice coil bobbin 140. The voice coil 130 winds around the voice coil bobbin 140. When the voice coil 130 vibrates, the voice coil bobbin 140 and the diaphragm 150 also vibrate with the voice coil 130 to produce sound. An outer diameter of the voice coil bobbin 140 can be determined by the power and the size of the loudspeaker 100. The outer diameter of the voice coil bobbin 140 can be in a range from about 1 millimeter to about 10 centimeters. A thickness of the voice coil bobbin 140 can be in a range from about 100 nanometers to about 500 micrometers.

The voice coil bobbin 140 includes a carbon nanotube layer structure. The carbon nanotube layer structure can be a free-standing structure, that is, the carbon nanotube layer structure can be supported by itself. The carbon nanotube layer structure curls to form a tubular structure. The carbon nanotube layer structure includes a plurality of carbon nanotubes. The carbon nanotube layer structure can be a pure structure of carbon nanotubes. The carbon nanotubes have a low density, about 1.35 g/cm$^3$, so the voice coil bobbin 140 is very light. As such, the efficiency of the loudspeaker 100 using the voice coil bobbin 140 will be improved. The carbon nanotubes in the carbon nanotube layer structure can be orderly or disorderly arranged. The term 'disordered carbon nanotube layer structure' refers to a structure where the carbon nanotubes are arranged along different directions, and the aligning directions of the carbon nanotubes are random. The number of the carbon nanotubes arranged along each different direction can be almost the same (e.g. uniformly disordered). The disordered carbon nanotube layer structure can be isotropic, namely the carbon nanotube layer structure has substantially identical properties in all directions of the carbon nanotube layer structure. The carbon nanotubes in the disordered carbon nanotube layer structure can be entangled with each other.

The term 'ordered carbon nanotube layer structure' refers to a structure where the carbon nanotubes are arranged in a consistently systematic manner, e.g., the carbon nanotubes are arranged approximately along a same direction and/or have two or more sections within each of which the carbon nanotubes are arranged approximately along a same direction (different sections can have different directions). The carbon nanotubes in the carbon nanotube layer structure can be single-walled, double-walled, and/or multi-walled carbon nanotubes.

Figure 3:
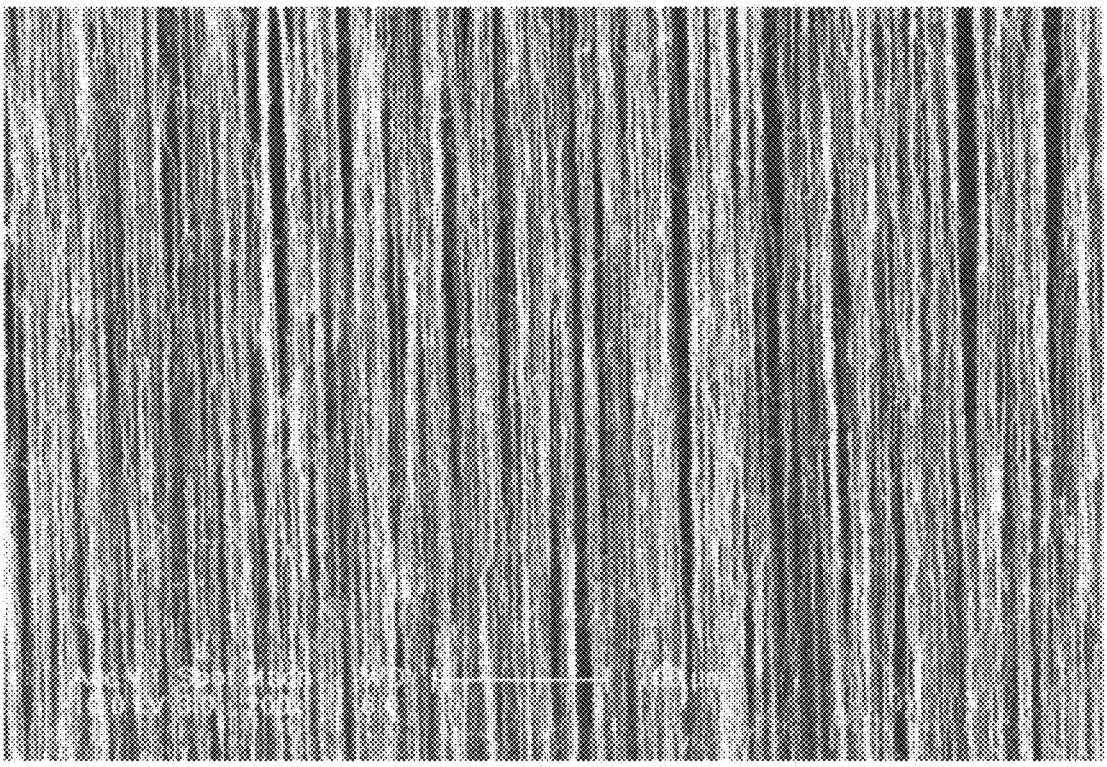
FIG. 3 is a Scanning Electron Microscope (SEM) image of a carbon nanotube film.

A thickness of the carbon nanotube layer structure can be in a range from about 100 nanometers to about 500 micrometers. The carbon nanotube layer structure can include at least one carbon nanotube film, at least one linear carbon nanotube structure or combination thereof. If the carbon nanotube layer structure includes at least one carbon nanotube film and at least one linear carbon nanotube structure, the at least one linear carbon nanotube structure can be disposed on a surface of the carbon nanotube film. If the carbon nanotube layer structure includes a plurality of linear carbon nanotube structures, the plurality of linear carbon nanotube structures can be substantially parallel to each other (not shown), crossed with each other, or weaved together to obtain a layer-shape structure In one embodiment, the carbon nanotube film is a drawn carbon nanotube film. A film can be drawn from a carbon nanotube array, to obtain a drawn carbon nanotube film. The drawn carbon nanotube film includes a plurality of successive and oriented carbon nanotubes joined end-to-end by van der Waals attractive force therebetween. The drawn carbon nanotube film is a free-standing film. Referring to FIG. 3, each drawn carbon nanotube film includes a plurality of successively oriented carbon nanotube segments joined end-to-end by van der Waals attractive force therebetween. Each carbon nanotube segment includes a plurality of carbon nanotubes substantially parallel to each other, and joined by van der Waals attractive force therebetween. As can be seen in FIG. 3, some variations can occur in the drawn carbon nanotube film. The carbon nanotubes in the drawn carbon nanotube film are oriented along a preferred orientation. The carbon nanotube film can be treated with an organic solvent to increase the mechanical strength and toughness of the carbon nanotube film and reduce the coefficient of friction of the carbon nanotube film. The thickness of the carbon nanotube film can range from about 0.5 nm to about 100 μm.

The carbon nanotube layer structure can include at least two stacked carbon nanotube films. In other embodiments, the carbon nanotube layer structure can include two or more coplanar carbon nanotube films, and can include layers of coplanar carbon nanotube films. Additionally, when the carbon nanotubes in the carbon nanotube film are aligned along one preferred orientation (e.g., the drawn carbon nanotube film), an angle can exist between the orientations of carbon nanotubes in adjacent films, whether stacked or adjacent. Adjacent carbon nanotube films can be joined by van der Waals attractive force therebetween. The number of the layers of the carbon nanotube films is not limited.

In other embodiments, the carbon nanotube film can be a flocculated carbon nanotube film. The flocculated carbon nanotube film can include a plurality of long, curved, disordered carbon nanotubes, entangled with each other. Further, the flocculated carbon nanotube film can be isotropic. The carbon nanotubes can be substantially uniformly dispersed in the carbon nanotube film. Adjacent carbon nanotubes are acted upon by van der Waals attractive force to obtain an entangled structure with micropores defined therein. Because the carbon nanotubes in the carbon nanotube layer structure are entangled with each other, the carbon nanotube layer structure employing the flocculated carbon nanotube film has excellent durability, and can be fashioned into desired shapes with a low risk to the integrity of the carbon nanotube layer structure. The thickness of the flocculated carbon nanotube film can range from about 0.5 nm to about 1 mm.

In other embodiments, the carbon nanotube film can be a pressed carbon nanotube film. The pressed carbon nanotube film can be a free-standing carbon nanotube film. The carbon nanotubes in the pressed carbon nanotube film are substantially arranged along a same direction or along different directions. The carbon nanotubes in the pressed carbon nanotube film can rest upon each other. Adjacent carbon nanotubes are attracted to each other and are joined by van der Waals attractive force. An angle between a primary alignment direction of the carbon nanotubes and a surface of the pressed carbon nanotube film is about 0 degrees to approximately 15 degrees.

The greater the pressure applied, the smaller the angle obtained. If the carbon nanotubes in the pressed carbon nanotube film are arranged along different directions, the carbon nanotube layer structure can be isotropic. Here, "isotropic" means the carbon nanotube film has properties substantially identical in all directions parallel to a surface of the carbon nanotube film. The thickness of the pressed carbon nanotube film ranges from about 0.5 nm to about 1 mm.

The linear carbon nanotube structure includes a plurality of carbon nanotubes joined end-to-end with each other by Van der Waals attractive force. The linear carbon nanotube structure can be a substantially pure structure of the carbon nanotubes, with few impurities. The carbon nanotubes in the linear carbon nanotube structure are substantially arranged along an axial direction of the linear carbon nanotube structure, and the linear carbon nanotube structure has good conductivity along its axial direction. The linear carbon nanotube structure can be a free-standing structure, that is, the linear carbon nanotube structure can be supported by itself and does not need a substrate to lie on and be supported thereby. For example, if a point of the linear carbon nanotube structure is held, the entire linear carbon nanotube structure can be lifted without being destroyed. A diameter of the linear carbon nanotube structure can be in a range from about 50 nanometers to about 3 millimeters. A ratio of length to diameter of the linear carbon nanotube structure can be in a range from about 50:1 to about 5000:1.

Furthermore, the carbon nanotubes in the linear carbon nanotube structure can form one or more carbon nanotube wires. If the linear carbon nanotube structure includes at least two carbon nanotube wires, the carbon nanotube wires can be twisted with each other.

Figure 4:
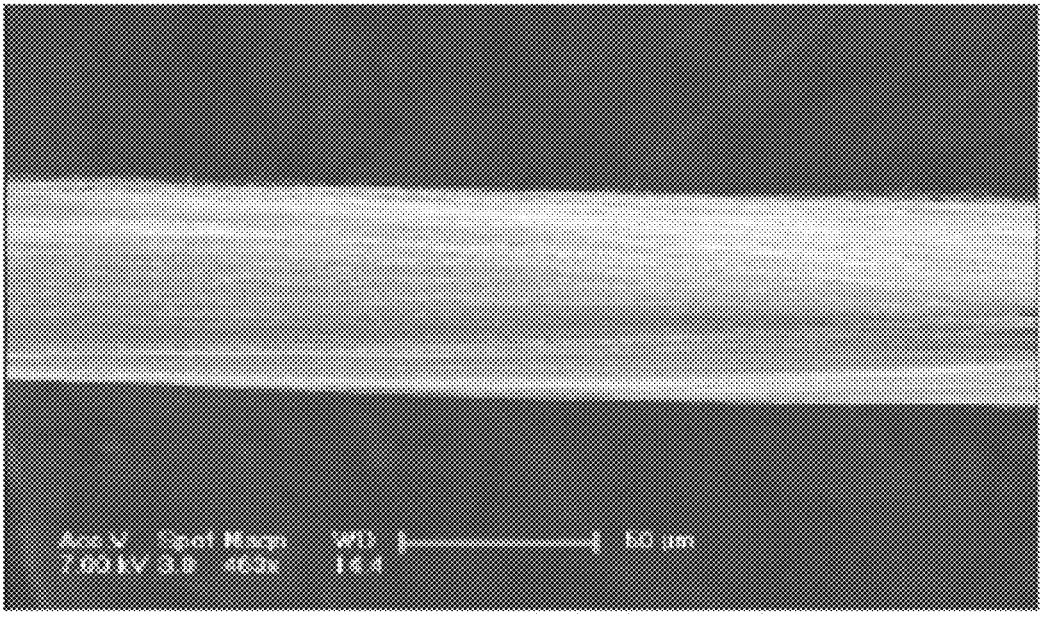
FIG. 4 is an SEM image of an untwisted carbon nanotube wire.

The carbon nanotube wire can be untwisted or twisted. Referring to FIG. 4, the untwisted carbon nanotube wire includes a plurality of carbon nanotubes substantially oriented along a same direction (i.e., a direction along the length direction of the untwisted carbon nanotube wire). The carbon nanotubes are substantially parallel to the axis of the untwisted carbon nanotube wire. In one embodiment, the untwisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. The carbon nanotube segments can vary in width, thickness, uniformity, and shape. The length of the untwisted carbon nanotube wire can be arbitrarily set as desired. A diameter of the untwisted carbon nanotube wire can range from about 50 nm to about 100 μm.

Figure 5:
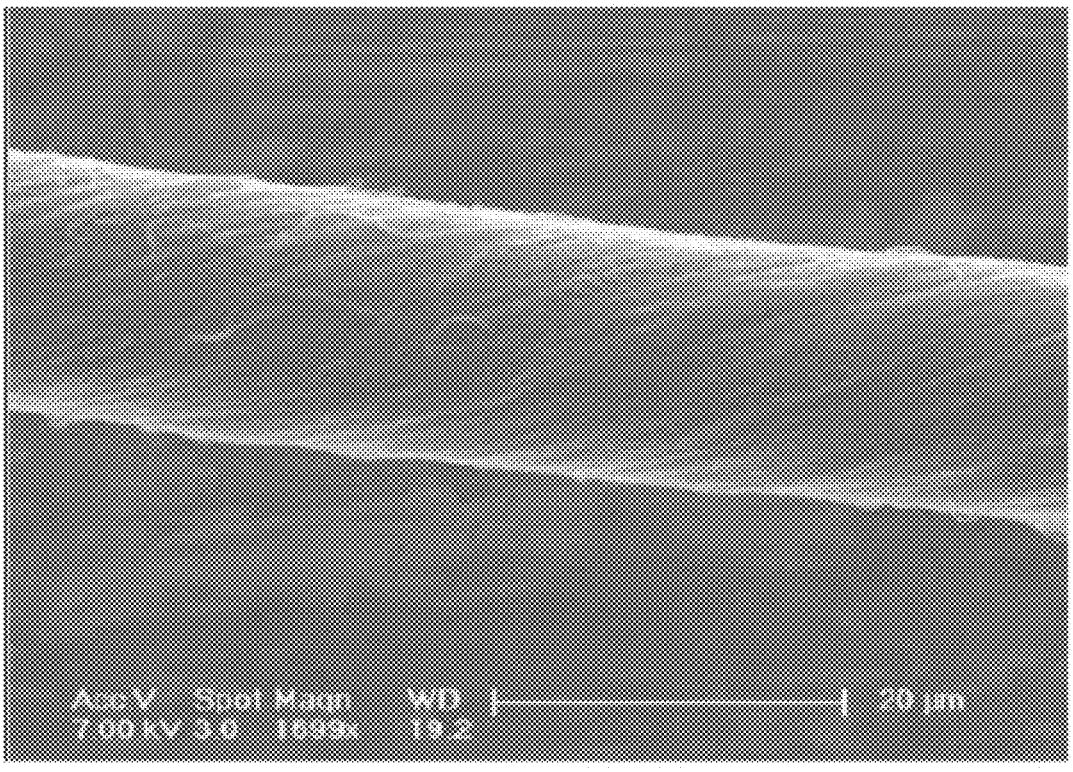
FIG. 5 is an SEM image of a twisted carbon nanotube wire.

Referring to FIG. 5, the twisted carbon nanotube wire includes a plurality of carbon nanotubes helically oriented around an axial direction of the twisted carbon nanotube wire. In one embodiment, the twisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. The length of the carbon nanotube wire can be set as desired. A diameter of the twisted carbon nanotube wire can be from about 50 nm to about 100 μm. Further, the twisted carbon nanotube wire can be treated with a volatile organic solvent after being twisted. After being soaked by the organic solvent, the adjacent substantially parallel carbon nanotubes in the twisted carbon nanotube wire will bundle together, due to the surface tension of the organic solvent as the organic solvent volatilizes. The specific surface area of the twisted carbon nanotube wire will decrease, while the density and strength of the twisted carbon nanotube wire will increase.

Figure 6:
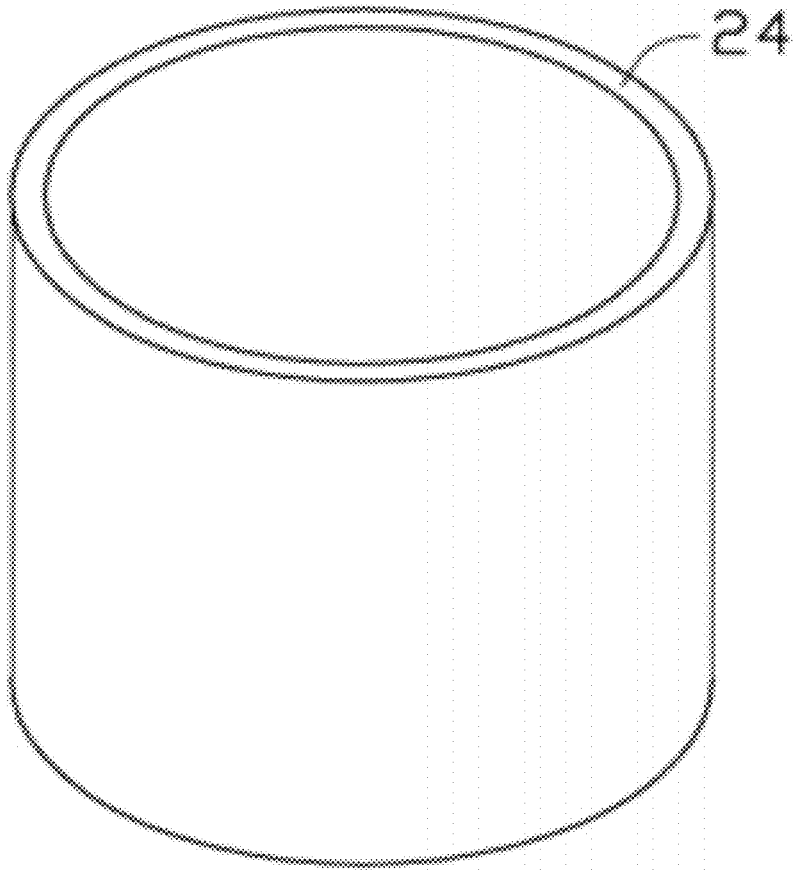
FIG. 6 is a schematic view of a voice coil bobbin including a carbon nanotube film according to one embodiment.
Figure 7:
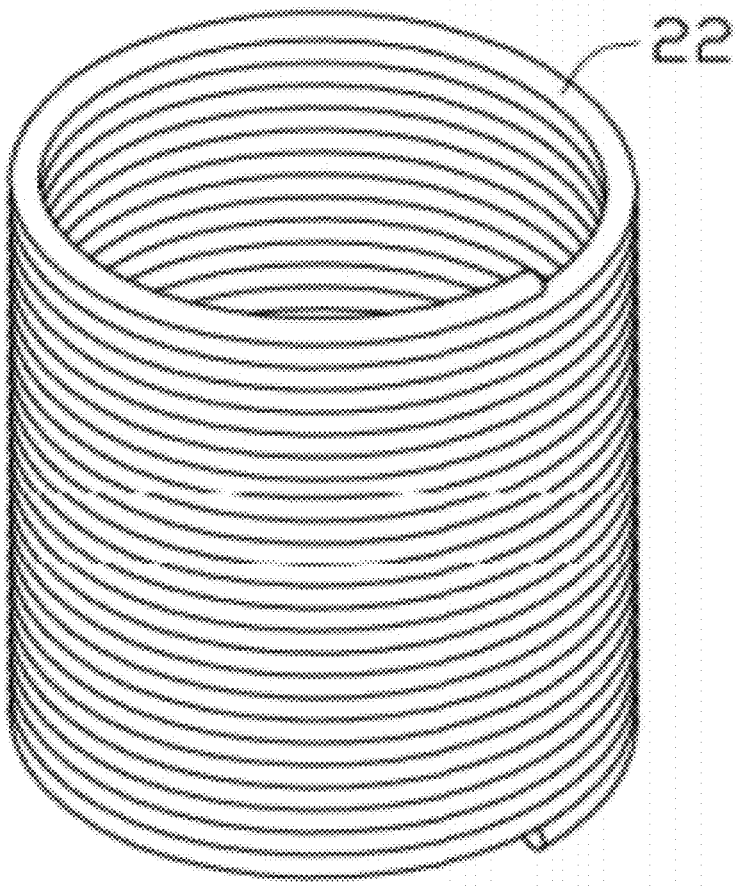
FIG. 7 is a schematic view of a voice coil bobbin including a linear carbon nanotube structure according to another embodiment.
Figure 8:
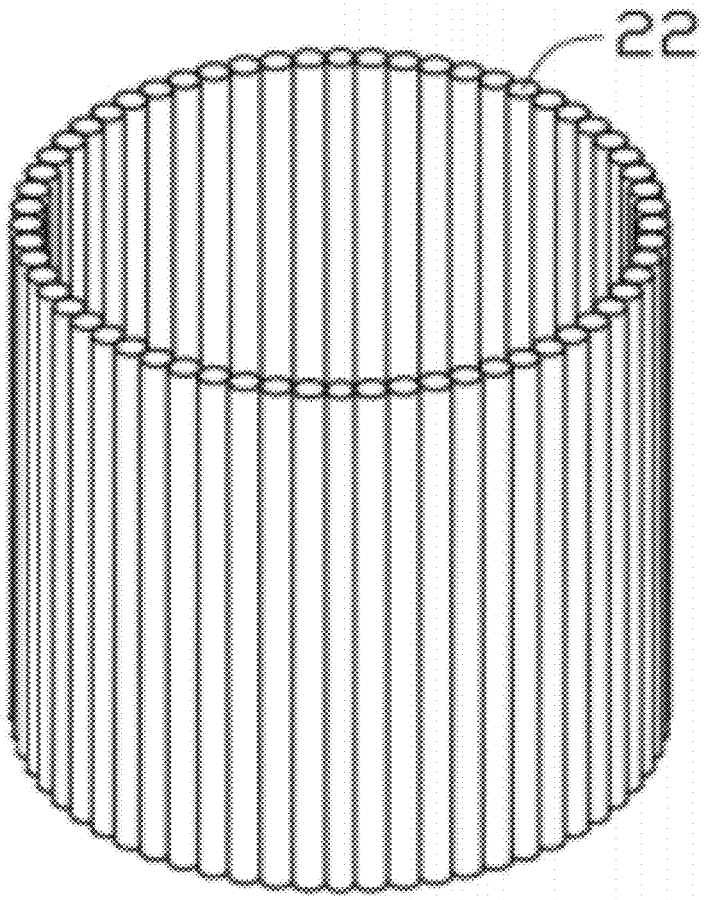
FIG. 8 is a schematic view of a voice coil bobbin including a plurality of linear carbon nanotube structures parallel with each other according to yet another embodiment.
Figure 9:
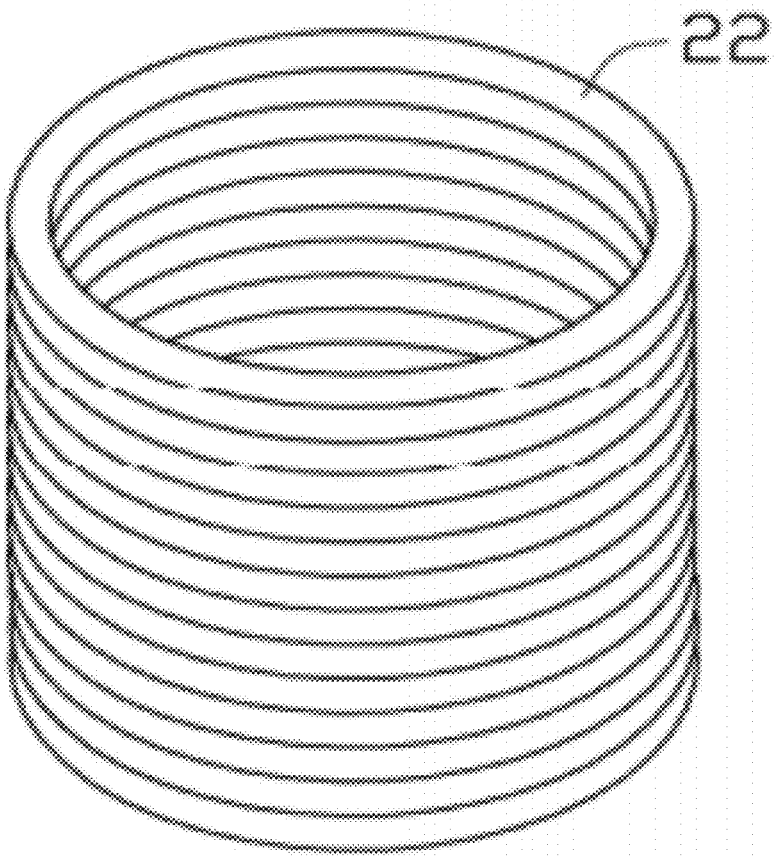
FIG. 9 is a schematic view of a voice coil bobbin including a plurality of linear carbon nanotube structure rings according to one embodiment.

Referring to FIG. 6, when the carbon nanotube layer structure includes at least one carbon nanotube film, the at least one carbon nanotube film curls to form the voice coil bobbin. Two opposite end of the carbon nanotube layer structure contacts and adheres with each other to form a cylindrical structure. The carbon nanotubes in the carbon nanotube layer structure can be oriented along a direction substantially parallel with an axial direction of the cylindrical structure. Referring to FIG. 7, if the carbon nanotube layer structure includes one linear carbon nanotube structure, the linear carbon nanotube structure is twisted to form the voice coil bobbin 140. The linear carbon nanotube structures twists to form a plurality of circles disposed closely to form a cylindrical structure. If the carbon nanotube layer structure includes a plurality of linear carbon nanotube structures, the plurality linear carbon nanotube structures can be disposed side by side and be substantially parallel with each other to form the voice coil bobbin 140 as shown in FIG. 8. The voice coil bobbin has a cylindrical structure, and each of the linear carbon nanotube structure is substantially parallel with an axis of the cylindrical structure. The plurality of linear carbon nanotube contact with each other closely. In another embodiment according to FIG. 9, each of the plurality of linear carbon nanotube structures can form a ring, and the plurality of rings is disposed side by side to form the voice coil bobbin. The ring is formed by two ends of one linear carbon nanotube structure contacting each other.

The voice coil bobbin 140 is used to support voice coil 130 and should have a stable shape. The voice coil bobbin 140 can be formed by the following steps:

S(1) providing a carbon nanotube layer structure;

S(2) providing a mold, such as a metal tube;

S(3) wrapping the mold with the carbon nanotube layer structure so that the carbon nanotube layer structure forms a substantially tubular structure;

S(4) heating the carbon nanotube layer structure to make the carbon nanotube layer structure maintain a stable shape; and S(5) separating the carbon nanotube layer structure and the mold.

In the step of S(4), the carbon nanotube layer structure is heated to a temperature from about 600° C. to about 2000° C. under vacuum or a protecting gas. Because the carbon nanotubes in the carbon nanotube layer structure are joined each other by Van der Waals attractive force, in the step of S(4), the carbon nanotubes will be soldered together, and the carbon nanotube layer structure will keep its tubular structure shape.

It is to be understood that the above-described embodiments are intended to illustrate rather than limit the present disclosure. Variations may be made to the embodiments without departing from the spirit of the disclosure as claimed. It is understood that any element of any one embodiment is considered to be disclosed to be incorporated with any other embodiment. The above-described embodiments illustrate the scope, but do not restrict the scope of the disclosure.

What is claimed is:

1. A loudspeaker comprising:

a magnetic circuit defining a magnetic gap;

a frame mounted on an side of the magnetic circuit;

a voice coil bobbin disposed in the magnetic gap, the voice coil bobbin comprising a carbon nanotube layer structure comprising a plurality of carbon nanotubes;

a voice coil wound around the voice coil bobbin.

2. The loudspeaker of claim 1, wherein the carbon nanotubes in the carbon nanotube layer structure are disposed uniformly.

3. The loudspeaker of claim 1, wherein the carbon nanotube layer structure is a pure structure of carbon nanotubes.

4. The loudspeaker of claim 1, wherein the carbon nanotube layer structure comprises at least one carbon nanotube film, at least one linear carbon nanotube structure, or a combination thereof.

5. The loudspeaker of claim 4, wherein the carbon nanotube film comprises a plurality of carbon nanotubes joined end-to-end with each other.

6. The loudspeaker of claim 5, wherein the carbon nanotubes in the carbon nanotube film are substantially parallel with each other.

7. The loudspeaker of claim 4, wherein the carbon nanotubes in the carbon nanotube film are entangled with each other.

8. The loudspeaker of claim 4, wherein the carbon nanotubes in the carbon nanotube film are overlapped with each other.

9. The loudspeaker of claim 4, wherein the carbon nanotube layer structure comprises a plurality of linear carbon nanotube structures disposed side by side and substantially parallel with each other to form the voice coil bobbin.

10. The loudspeaker of claim 4, wherein the carbon nanotube layer structure comprises a plurality of linear carbon nanotube structures, each linear carbon nanotube structure forms a ring, and the plurality of rings are arranged side by side to form the voice coil bobbin.

11. The loudspeaker of claim 4, wherein the at least one linear carbon nanotube structure comprises a plurality of carbon nanotubes joined end-to-end with each other by Van der Waals attractive force.

12. The loudspeaker of claim 11, wherein the carbon nanotubes in the linear carbon nanotube structure are substantially arranged along an axial direction of the linear carbon nanotube structure.

13. The loudspeaker of claim 11, wherein the linear carbon nanotube structure comprises at least one untwisted carbon nanotube wire comprising a plurality of carbon nanotubes substantially oriented in an axial direction of the at least one untwisted carbon nanotube wire.

14. The loudspeaker of claim 11, wherein the linear carbon nanotube structure comprises at least one twisted carbon nanotube wire comprising a plurality of carbon nanotubes helically oriented around an axial direction of the at least one twisted carbon nanotube wire.

15. The loudspeaker of claim 1, wherein the carbon nanotube layer structure comprises at least one carbon nanotube film curled to form the voice coil bobbin via two opposite ends of the at least one carbon nanotube film contacting each other, the voice coil bobbin forming a cylindrical structure.

16. The loudspeaker of claim 15, wherein the carbon nanotubes in the carbon nanotube layer structure are oriented along a direction substantially parallel with an axial direction of the voice coil bobbin.

17. The loudspeaker of claim 1, wherein the carbon nanotube layer structure comprises a linear carbon nanotube structure twisting to form a plurality of circles disposed closely to form a tubular structure.

18. A loudspeaker comprising:

a voice coil bobbin having a tubular structure comprising a carbon nanotube layer structure comprising a plurality of carbon nanotubes, the tubular structure being formed by curling the carbon nanotube layer structure.

19. A voice coil bobbin comprising:

a carbon nanotube layer structure forming a tubular structure, wherein the carbon nanotube layer structure comprises a plurality of carbon nanotubes disposed uniformly.

20. The voice coil bobbin of claim 19, wherein the carbon nanotube layer structure is a pure structure of carbon nanotubes.

* * * * *